US010711415B1

(12) United States Patent
Vaughan, Jr.

(10) Patent No.: US 10,711,415 B1
(45) Date of Patent: Jul. 14, 2020

(54) HIGHWAY CRASH BARREL

(71) Applicant: Earl Vaughan, Jr., Linn, MO (US)

(72) Inventor: Earl Vaughan, Jr., Linn, MO (US)

( * ) Notice: Subject to any disclaimer, the term of this patent is extended or adjusted under 35 U.S.C. 154(b) by 0 days.

(21) Appl. No.: 16/353,098

(22) Filed: Mar. 14, 2019

(51) Int. Cl.
*E01F 9/00* (2016.01)
*E01F 9/654* (2016.01)
*E01F 9/688* (2016.01)

(52) U.S. Cl.
CPC ..... *E01F 9/654* (2016.02); *E01F 9/688* (2016.02)

(58) Field of Classification Search
CPC ..... E01F 9/00; E01F 9/658; E01F 9/688
USPC ..... 404/6, 10, 72, 75
See application file for complete search history.

(56) References Cited

U.S. PATENT DOCUMENTS

D229,784 S 1/1974 Carter
5,630,675 A * 5/1997 Boeger ..... E01F 9/692 116/63 C
5,927,896 A * 7/1999 Gertz ..... E01F 15/146 404/10
6,071,037 A * 6/2000 Holt ..... A47F 3/142 116/63 P
D440,172 S 4/2001 Cuttill et al.
6,478,505 B1 11/2002 Culp et al.
6,491,470 B1 * 12/2002 Gertz ..... E01F 15/003 404/10
D482,631 S 11/2003 Brown
D485,775 S 1/2004 Smith et al.
D486,089 S 2/2004 Mettler et al.
6,786,673 B2 9/2004 Kulp et al.
6,835,024 B1 * 12/2004 Gertz ..... E01F 15/146 256/13.1
7,156,576 B1 1/2007 Kulp et al.
7,175,361 B1 * 2/2007 Gertz ..... E01F 15/003 404/6
9,082,304 B2 7/2015 Benn
9,493,919 B2 * 11/2016 Handy ..... E01F 9/688
9,797,102 B2 10/2017 Maus et al.
2012/0207541 A1 * 8/2012 Maus ..... E01F 15/086 404/6
2014/0270937 A1 * 9/2014 Kulkarni ..... E01F 15/083 404/6

* cited by examiner

*Primary Examiner* — Raymond W Addie
(74) *Attorney, Agent, or Firm* — Cramer Patent & Design, PLLC; Aaron R. Cramer

(57) ABSTRACT

A highway crash barrel incorporates a first portion and a second portion capable of interlocking with each other. A ballast is present in the first portion and a hollow portion is present in the second portion.

16 Claims, 5 Drawing Sheets

HIGHWAY CRASH BARREL

FIELD OF THE INVENTION

The present invention relates to a highway crash barrel.

BACKGROUND OF THE INVENTION

Street and highway safety is at the forefront of concerns when speaking in regards to public safety. One type of system that is frequently used to avoid accidents and reduce death tolls are vehicle barrier systems. These are mechanical system that rely on absorbing impact energy itself rather than passing it the impacting vehicle and its occupants. A common type of system utilizes barrels filled with sand, water, or other material to perform this task.

While such barrels work well, they are difficult to handle and stack due to their large size. Even after they are stacked, they are difficult to separate due to the vacuum that is formed between the components. Additionally, should lids come off, or bottoms fails, the contained material can spill all over adjacent road surfaces resulting in costly and dangerous cleanup. Accordingly, there exists a need for a means by which a vehicle barrier can be modified to address the above concerns. The development of the highway crash barrel fulfills this need.

SUMMARY OF THE INVENTION

It is therefore an object of the present invention to provide a safety crash barrel, comprising a lower barrel half providing with an open interior and an upper barrel half sitting atop a lower barrel half. The lower barrel half and the upper barrel half are joined together by a twist lock fitting. The upper barrel half and the lower barrel half utilize tapered sides that facilitate stacking when empty. The open interior may be used to hold a first ballast. The first ballast may be selected from the group consisting of sand, water, or high-density material.

The lower barrel half may be made from high density polyethylene plastic along with a first one or more ultraviolet inhibitors that are retro-reflective. The lower barrel half and the upper barrel half may be stacked and utilize tapered sides that facilitate stacking when empty. The upper barrel half may be made from high density polyethylene plastic along with a second one or more ultraviolet inhibitors that are retro-reflective. The upper barrel half and the lower barrel half may be provided with a reinforced flared rim to enhance strength and provide structural rigidity. An upper portion of the lower barrel half may be provided with a male flange which interlocks with the upper barrel half. The male locking tabs may be provided on the upper surface of the male flange to facilitate interlocking. The three male locking tabs are arranged at one-hundred-twenty degrees from each other. Each of the male locking tab includes a male open slot and a male locking arm. Each of the male locking tab may also be symmetrical to their counterparts and allow for matching the lower barrel half and the upper barrel half at any one-hundred-twenty-degree segment.

The upper barrel half may be filled with a second ballast to increase overall mass of the safety crash barrel to aid in stopping wayward motor vehicles. The second ballast may be selected from the group consisting of sand, water, or other high-density material. The upper barrel half may include a female flange and a reinforced flared rim in the open interior. The female flange is provided with three female locking tabs. Each female locking tab is arranged at one-hundred-twenty degrees to each other. Additionally, each female locking tab may also include a female open slot and a female locking arm. During engagement of the upper barrel half with the lower barrel half, an individual the male locking tab engages with an individual the female locking tab, accomplished by placing the female locking arm under the male locking arm and rotating in place by five degrees. The safety crash barrel may be forty-eight inches high with a maximum diameter of thirty inches.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
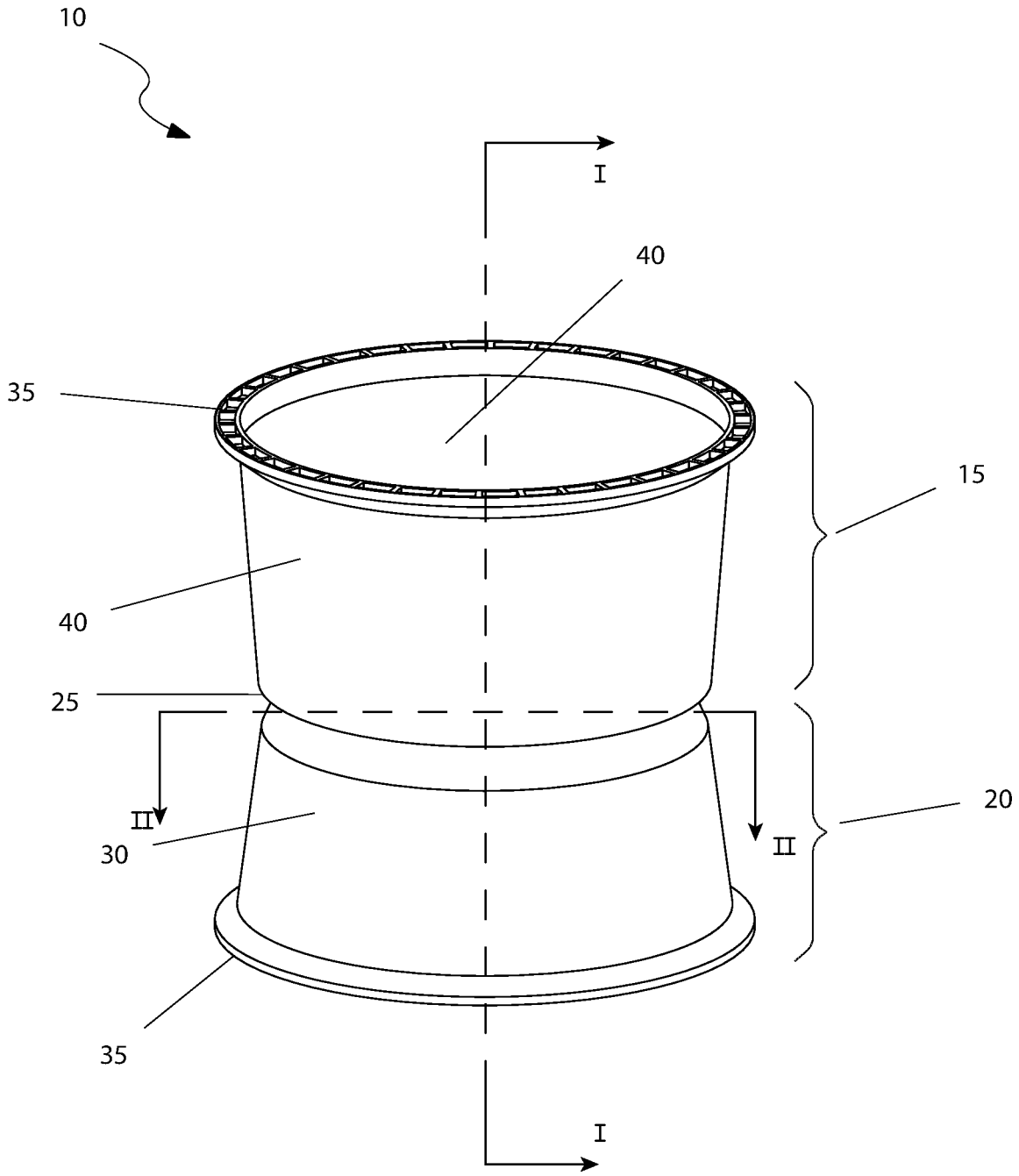
FIG. 1 is a perspective view of the safety crash barrel 10, according to the preferred embodiment of the present invention.

10 safety crash barrel
15 upper barrel half
20 lower barrel half
25 twist lock fitting
30 tapered side
35 reinforced flared rim
40 ballast
45 open interior
50 male flange
55 male locking tab
60 male open slot
65 male locking arm
70 female flange
75 female locking tab
80 female open slot
85 female locking arm

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the safety crash barrel 10, according to the preferred embodiment of the present invention is disclosed. The safety crash barrel 10 (herein also described as the "device") 10, includes an upper barrel half 15 sitting atop a lower barrel half 20. They are joined together by a twist lock fitting 25 which will be described in greater detail herein below. It is envisioned that both the upper barrel half 15 and the lower barrel half 20 would be made from high density polyethylene plastic along with ultraviolet inhibitors, that are retro reflective. The overall height of the device 10 is envisioned to be approximately forty-eight inches (48 in.) with a maximum diameter of thirty inches (30 in.).

Both the upper barrel half 15 and the lower barrel half 20 utilized tapered sides 30 that facilitate stacking when empty. Stacking can occur with multiple upper barrel halves 15, multiple lower barrel half 20, or a combination of an upper barrel half 15 and a lower barrel halves 20. Likewise, both the upper barrel half 15 and the lower barrel half 20 are provided with a reinforced flared rim 35 to enhance strength and provide structural rigidity. The upper barrel half 15 may be filled with ballast 40 such as sand, water, or other high-density material to increase overall mass of the device 10 to aid in stopping of wayward motor vehicles. Additional information on placement of the ballast 40 will be provided herein below.

Figure 2:
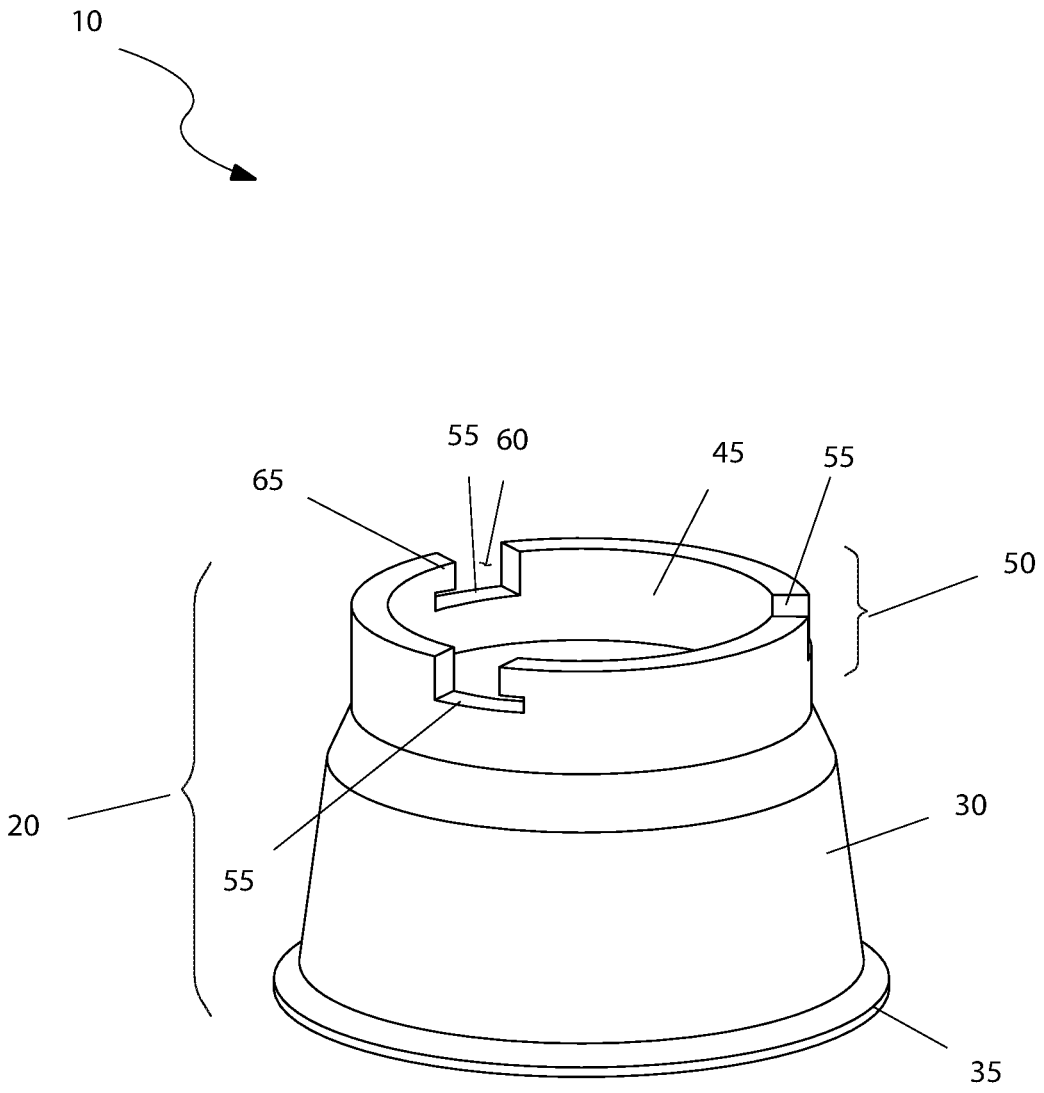
FIG. 2 is a perspective view of the lower barrel half 20 as used with the safety crash barrel 10, according to the preferred embodiment of the present invention.

Referring next to FIG. 2, a perspective view of the lower barrel half 20 as used with the device 10, according to the preferred embodiment of the present invention is depicted. The lower barrel half 20 is provided with an open interior 45 which may also be used to hold ballast 40. The upper portion of the lower barrel half 20 is provided with a male flange 50 which interlocks with the upper barrel half 15 as will be described in greater detail herein below. To facilitate this mating, three (3) male locking tabs 55 are provided in the upper surface of the male flange 50. The male locking tabs 55 are arranged at one-hundred-twenty degrees (120°) from each other. Each male locking tab 55 includes a male open slot 60 and a male locking arm 65. Each male locking tab 55 is symmetrical to their counterparts and allow for matching the lower barrel half 20 and the upper barrel half 15 at any one-hundred-twenty-degree (120°) segment. The tapered sides 30 and the reinforced flared rim 35 are also visible in this figure.

Figure 3:
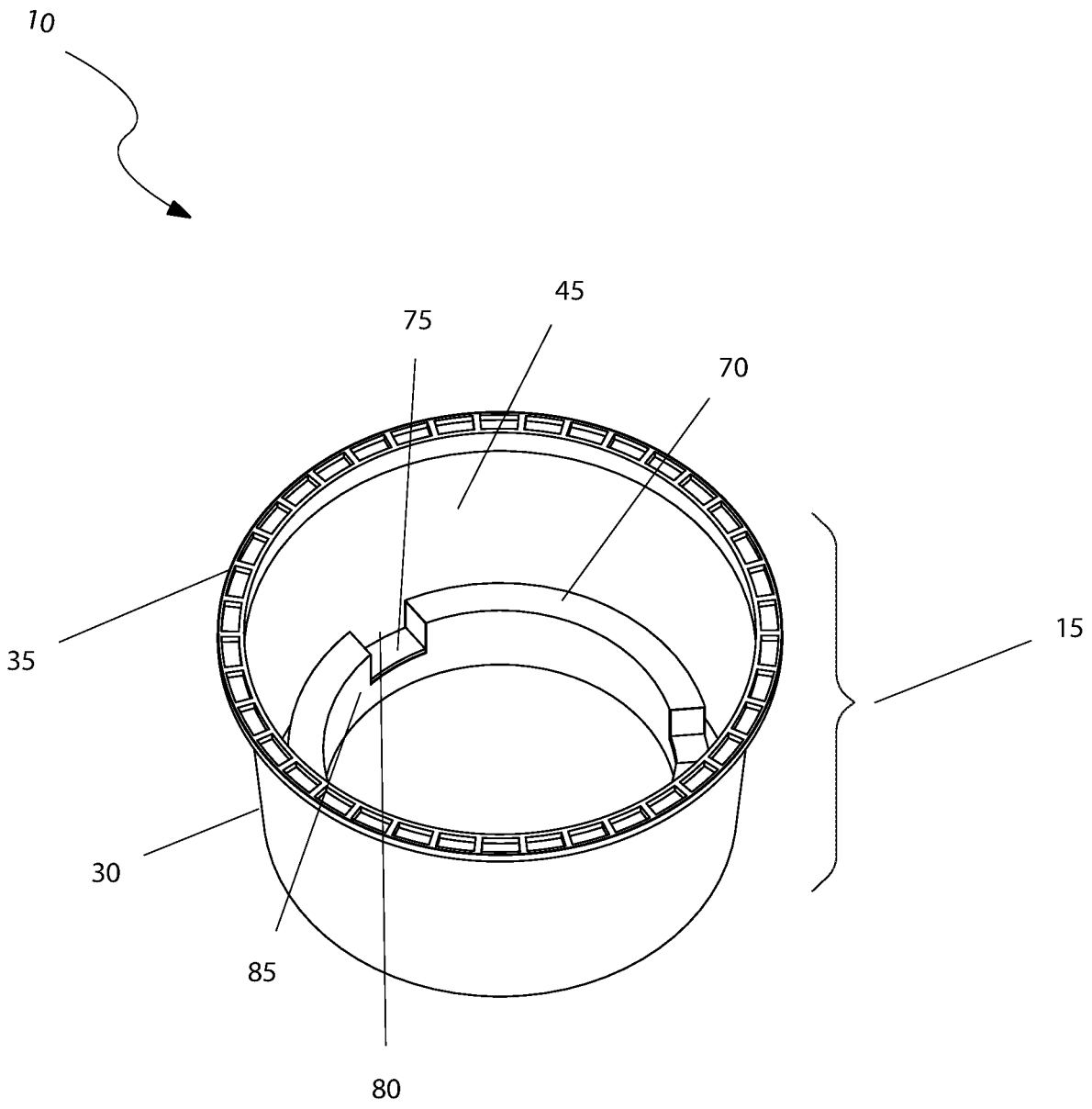
FIG. 3 is a perspective view of the upper barrel half 15 as used with the safety crash barrel 10, according to the preferred embodiment of the present invention.

Referring now to FIG. 3, a perspective view of the upper barrel half 15 as used with the device 10, according to the preferred embodiment of the present invention is shown. The upper barrel half 15 in this figure is empty of ballast 40 (as shown in FIG. 1) and exposes a female flange 70 in its open interior 45. As before, the tapered sides 30 and the reinforced flared rim 35 remain visible. The female flange 70 is provided with three (3) female locking tabs 75 of which only one (1) is visible due to illustrative limitations. Each female locking tab 75 is arranged at one-hundred-twenty degrees (120°) to each other. Each female locking tab 75 includes a female open slot 80 and a female locking arm 85. During engagement of the upper barrel half 15 with the lower barrel half 20 (as shown in FIG. 1), an individual male locking tab 55 (as shown in FIG. 2) engages with an individual female locking tab 75, accomplished by placing the female locking arm 85 under the male locking arm 65 (as shown in FIG. 2) and rotating in place by approximately five degrees (5°).

Figure 4:
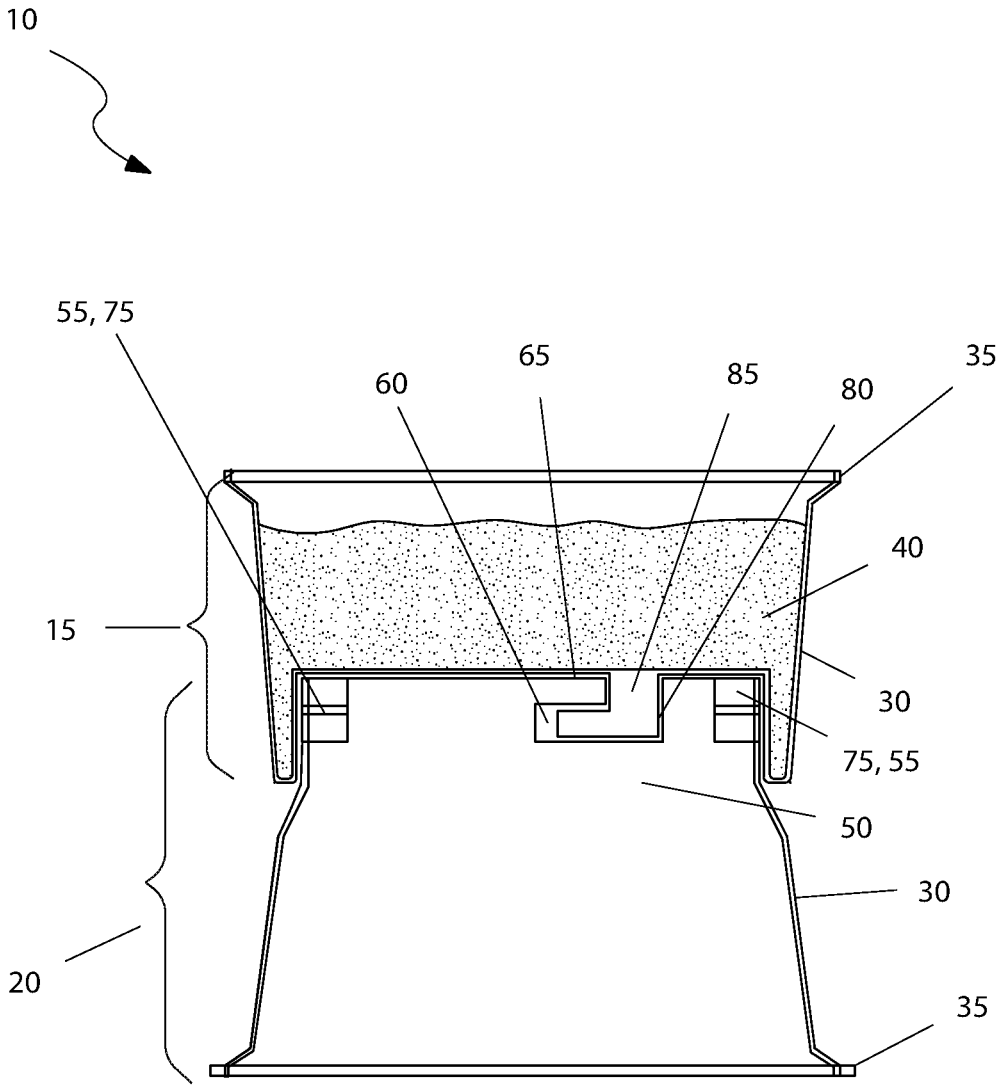
FIG. 4 is a sectional view of the safety crash barrel 10, as seen along a line I-I, as shown in FIG. 1, according to the preferred embodiment of the present invention; and, FIG. 5 is a sectional view of the safety crash barrel 10, as seen along a line II-II, as shown in FIG. 1, according to the preferred embodiment of the present invention.

Referring next to FIG. 4, a sectional view of the device 10, as seen along a line I-I, as shown in FIG. 1, according to the preferred embodiment of the present invention is disclosed. The upper barrel half 15 is coupled to the lower barrel half 20. The tapered sides 30 of the lower barrel half 20 tapers inward to the male flange 50 with the three (3) male locking tabs 55 located atop. This view clearly discloses the male open slot 60 and the male locking arm 65 of the male locking tabs 55 interlocking with the female open slot 80 and female locking arm 85 of the female locking tabs 75. As expected, an additional amount of ballast 40 is contained within the upper barrel half 15 with the reinforced flared rim 35 atop presenting an open state.

Figure 5:
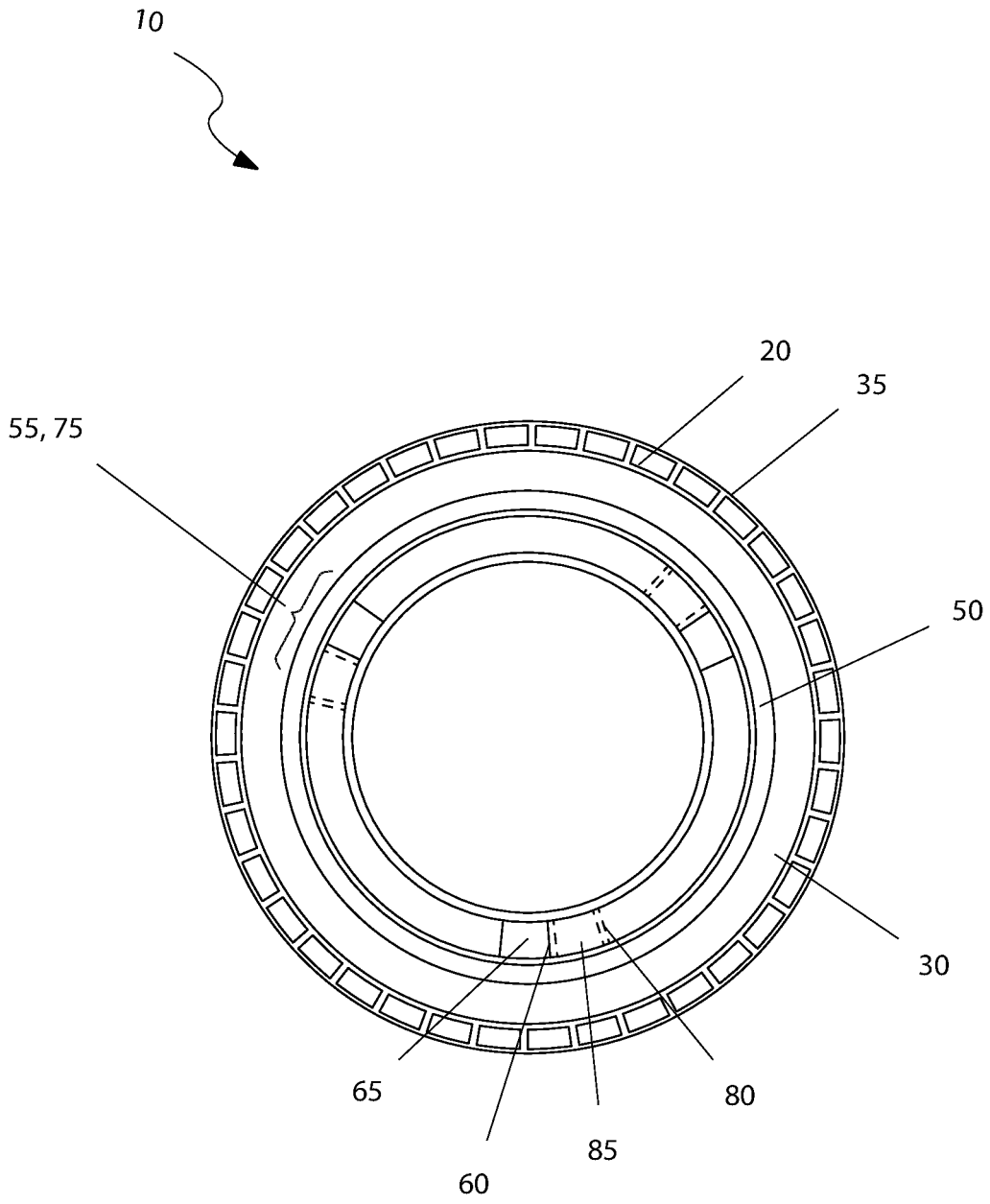

Referring to FIG. 5, a sectional view of the device 10, as seen along a line II-II, as shown in FIG. 1, according to the preferred embodiment of the present invention is depicted. The downward looking view of the figure primarily discloses the lower barrel half 20 with its reinforced flared rim 35 at the outer perimeter. The tapered sides 30 tapers upward to the male flange 50 which provides the three (3) male locking tabs 55 as well as the three (3) female locking tabs 75. As aforementioned described, the male open slot 60 and the male locking arm 65 of the male locking tabs 55 interlocks with the female open slot 80 and female locking arm 85 of the female locking tabs 75.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 through conventional procurement channels while paying particular attention to parameters such as overall size, color, coordination with existing stock, quantity of devices 10 needed and the like.

After procurement and prior to utilization, the device 10 would be prepared in the following manner: the upper barrel half 15 and the lower barrel half 20, in an empty state, would be stacked within each other, while in storage or transport to the needed roadway site.

During utilization of the device 10, the following procedure would be initiated: the lower barrel half 20 would be placed as needed to contain, direct, or otherwise restrict motor vehicle traffic flow, a upper barrel half 15 would then be set atop the lower barrel half 20 and twisted so as to lock the male locking tabs 55 to the female locking tabs 75; finally, the upper barrel half 15 would be filled with ballast 40.

After use of the device 10, it may be lifted with a mechanical aid such as a crane or forklift and transported to a new needed location or stored until needed again. It is also envisioned that the ballast 40 may be emptied from the upper barrel half 15 allowing the upper barrel half 15 and lower barrel half 20 to be separated. The upper barrel half 15 and lower barrel half 20 maybe stacked with each other for storage until needed again in a repeating manner.

It is envisioned that use of the device 10 increases safety by preventing inadvertent separation near traffic flow. Additionally, since the twist lock fitting 25 remains elevated above the roadway surface, contaminants such as tar, cannot reach it. As such, separation remains easy.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A safety crash barrel, comprising:

a lower barrel half providing with an open interior; and an upper barrel half sitting atop a lower barrel half, said lower barrel half and said upper barrel half are joined together by a twist lock fitting, said upper barrel half and said lower barrel half utilizing tapered sides that facilitate stacking when empty wherein an upper portion of said lower barrel half is provided with a male flange which interlocks with said upper barrel half;

wherein three male locking tabs are provided on said upper surface of said male flange to facilitate interlocking;

wherein said three male locking tabs are arranged at one-hundred-twenty degrees from each other;

wherein each said male locking tab includes a male open slot and a male locking arm.

2. The safety crash barrel according to claim 1, wherein said open interior is used to hold a first ballast.

3. The safety crash barrel according to claim 2, wherein said first ballast is selected from the group consisting of sand, water, or high-density material.

4. The safety crash barrel according to claim 1, wherein said lower barrel half is made from high density polyethylene plastic along with a first one or more ultraviolet inhibitors that are retro-reflective.

5. The safety crash barrel according to claim 1, wherein said lower barrel half and said upper barrel half are stacked and utilize tapered sides that facilitate stacking when empty.

6. The safety crash barrel according to claim 1, wherein said upper barrel half is made from high density polyethylene plastic along with a second one or more ultraviolet inhibitors that are retro-reflective.

7. The safety crash barrel according to claim 1, wherein said upper barrel half and said lower barrel half are provided with a reinforced flared rim to enhance strength and provide structural rigidity.

8. The safety crash barrel according to claim 1, wherein during engagement of said upper barrel half with said lower barrel half, an individual said male locking tab engages with an individual said female locking tab, accomplished by placing said female locking arm under said male locking arm and rotating in place by five degrees.

9. The safety crash barrel according to claim 1, wherein said safety crash barrel is forty-eight inches high with a maximum diameter of thirty inches.

10. The safety crash barrel according to claim 1, wherein said each said male locking tab is symmetrical to their counterparts and allow for matching said lower barrel half and said upper barrel half at any one-hundred-twenty-degree segment.

11. The safety crash barrel according to claim 1, wherein said upper barrel half is filled with a second ballast to increase overall mass of said safety crash barrel to aid in stopping wayward motor vehicles.

12. The safety crash barrel according to claim 1, wherein said second ballast is selected from the group consisting of sand, water, or other high-density material.

13. The safety crash barrel according to claim 1, wherein said upper barrel half includes a female flange and a reinforced flared rim in said open interior.

14. The safety crash barrel according to claim 13, wherein said female flange is provided with three female locking tabs.

15. The safety crash barrel according to claim 14, wherein each said female locking tab is arranged at one-hundred-twenty degrees to each other.

16. The safety crash barrel according to claim 15, wherein said each said female locking tab includes a female open slot and a female locking arm.

* * * * *